United States Patent [19]

Stoltz

[11] 4,154,351

[45] May 15, 1979

[54] CANTED ROLLER APPARATUS FOR MOVING OBJECTS

[76] Inventor: Woodrow W. Stoltz, P.O. Box 35103, Tulsa, Okla. 74135

[21] Appl. No.: 815,907

[22] Filed: Jul. 15, 1977

[51] Int. Cl.[2] ..... B65H 51/26

[52] U.S. Cl. ..... 414/432; 104/166

[58] Field of Search ..... 214/338, 339, 340; 198/782, 786; 104/163, 166

[56] References Cited

U.S. PATENT DOCUMENTS

| | | | |
|---|---|---|---|
| 2,780,252 | 2/1957 | Gyllenberg | 214/339 X |
| 3,164,104 | 1/1965 | Hunt | 104/166 |
| 3,446,367 | 5/1969 | Anderson | 214/339 X |
| 3,447,074 | 5/1969 | Sower et al. | 214/338 X |
| 3,743,124 | 7/1973 | Jarvis | 214/338 |
| 3,861,322 | 1/1975 | Danly | 104/166 |

*Primary Examiner*—Albert J. Makay

*Attorney, Agent, or Firm*—Head, Johnson & Chafin

[57] ABSTRACT

Apparatus for moving objects which comprises at least one roller journalled for engagement with the object to be moved whereby rotation of the roller causes the object to move in a longitudinal and/or rotational direction. The axis of the roller may be canted or angularly disposed with respect to the longitudinal direction of travel for the object in order to control the speed of movement of the object.

5 Claims, 3 Drawing Figures

CANTED ROLLER APPARATUS FOR MOVING OBJECTS

CROSS REFERENCE TO RELATED APPLICATIONS

This application is related to my co-pending applications entitled, "Pipe Coating System" and "Telescoping Vehicles"

BACKGROUND OF THE INVENTION

1. Field of the Invention

This invention relates to improvements in apparatus for moving objects and more particularly, but not by way of limitation, to adjustable roller means for moving objects in a longitudinal and/or rotational direction, and for controlling the rate of speed of movement thereof.

2. Description of the Prior Art

It is frequently desirable to move objects in a longitudinal and/or rotational manner, particularly during instances wherein the objects are being treated, or the like. For example, in a pipe coating operation as set forth in my aforementioned co-pending applications, pipe sections are moved in end-to-end sequential relation through the various steps of the coating operation. It is important that the individual pipe sections be moved continuously in a longitudinal direction, and it is also important that the pipe sections be rotated about their own longitudinal axes during the longitudinal movement thereof. Pipe sections are frequently relatively long and may be of relatively large diameters; and as a consequence, the movement thereof creates many problems. The overall situation is aggrevated in a pipe coating operation since it is important that the outer periphery of the pipe not be contacted subsequent to the actual application of the coating material thereon, but it is still important that the pipe sections being coated are moving longitudinally and rotationally in order to achieve an efficient and thorough coating of the pipe.

As set forth in my aforementioned applications, the pipe sections being coated may be carried by wheeled vehicles which ride freely through the coating steps or sections of the system and are supported on the vehicles by means of end plug means which engage only the inner periphery of each pipe section at the opposite ends thereof. The plug means is freely rotatable, and thus the pipe sections may be rotated and moved longitudinally as they are carried by the vehicles. However, it has heretofore been difficult to accomplish this combined longitudinal and rotational movement for pipe sections during a coating operation.

SUMMARY OF THE INVENTION

The present invention contemplates a novel roller apparatus having at least one roller adapted for engagement with the outer periphery of an object, such as a pipe section, for transmitting longitudinal and/or rotational movement to the object. The roller means is preferably suitably journalled in an elevated position for engagement with the upper portion of the object or pipe section; and as the roller is driven or rotated, the engagement with the pipe causes the pipe section, which is suitably supported or suspended, such as by the wheeled vehicles of my co-pending application entitled "Telescoping Vehicles", will cause the pipe to rotate about its own longitudinal axis. In the event the axis of the roller is substantially perpendicular to the longitudinal axis of the pipe section engaged thereby, the pipe section will be moved in a longitudinal direction without any rotational movement being translated to the pipe section. However, in the event it is desirable to move the pipe section in a longitudinal direction, the angular disposition of the axis of the roller may be adjusted with respect to the longitudinal axis of the pipe section whereby not only will the pipe be rotated about the longitudinal axis, but also the pipe will be moved in a longitudinal direction. It will be apparent that the angular position of the axis of the roller with respect to the longitudinal axis of the pipe and the rate of rotation speed of the roller will control the rotational and longitudinal speed of movement for the pipe section. Of course, when the axis of the roller is positioned in substantial alignment with the longitudinal axis of the pipe section, the pipe section will be rotated by the engagement of the roller with the outer periphery thereof. However, in this relative position between the roller and pipe, there will be no longitudinal movement translated to the pipe section.

DESCRIPTION OF THE PREFERRED EMBODIMENT

Figure 1:
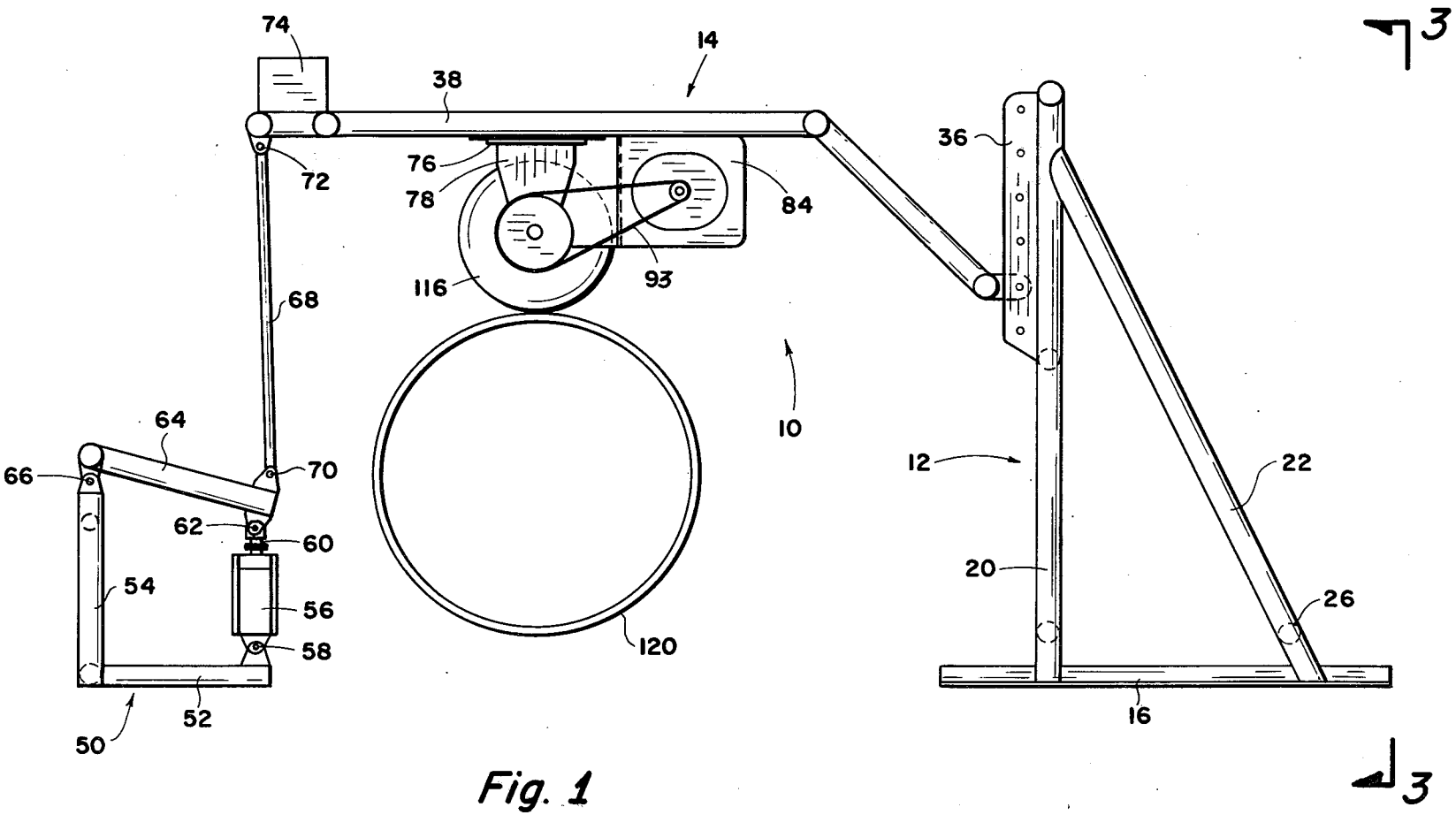
FIG. 1 is a side elevational view of a drive roller apparatus embodying the invention.

Referring to the drawings in detail, reference character 10 generally indicates a drive apparatus comprising an upright standard or support structure 12 having a substantially horizontally extending drive assembly 14 pivotally secured thereto and extending outwardly therefrom in substantial perpendicular relation thereto. The support structure 12 may be of any suitable type, and as shown herein comprises a pair of spaced substantially parallel angle members 16 and 18 disposed on the surface of the ground, or the like, having an upright substantially rectangular frame 20 secured therebetween in the proximity of one end thereof. A first angularly disposed brace member 22 is secured between the angle member 16 and the frame 20, and a second angularly disposed brace member 24 (FIG. 2) is similarly secured between the angle member 18 and the frame 20 for securely supporting the frame in said upright position. It is preferable to provide a cross member 26 between the outer ends of the brace members 22 and 24 for stability.

Figure 3:
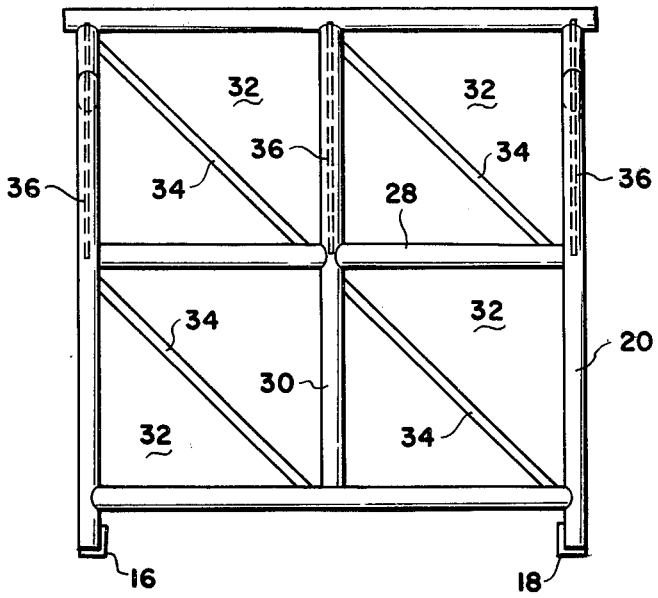
FIG. 3 is a view taken on line 3—3 of FIG. 1, with a portion eliminated for purposes of illustration.

The frame 20 is preferably provided with a centrally disposed horizontally extending cross member 28 and a centrally disposed vertically extending cross member 30 for forming a plurality of smaller rectangular areas 32 within the frame 20 as particularly shown in FIG. 3. A diagonally extending brace member 34 is secured in each of the areas 32, thus providing rigidity and strength for the frame 20, as is well known. The outer edge or left-hand side of the frame 20 as viewed in FIGS. 1 and 2 is provided with a plurality of spaced vertically extending bracket member 36 for pivotally securing the drive assembly 14 to the frame 20, as will be hereinafter set forth.

The drive assembly 14 as shown herein preferably comprises a pair of substantially identical rectangular frames 38 and 40 disposed with the plane thereof substantially parallel to the ground or floor (not shown). In addition, it is preferable that the frames 38 and 40 be disposed in the proximity of the upper end of the frame 20 for a purpose as will be hereinafter set forth. The frame 38 is provided with a transversely extending tube or rod member 42 on the inwardly directed end thereof adjacent the frame 20, and each end of the cross member 42 has a link member 44 pivotally secured thereon. The links 44 are also pivotally secured to the respective brackets 36, thus pivotally securing the frame 38 to the associated brackets 36. The frame 40 is preferably provided with a similar tubular cross member 46 extending transversely across the inner end thereof in substantial alignment with the cross member 42. Each end of the cross member 46 is provided with a link member 48 pivotally secured thereto, and each link 48 is pivotally secured to the respective bracket 36 for pivotally securing the frame 40 to the frame 20.

Figure 2:
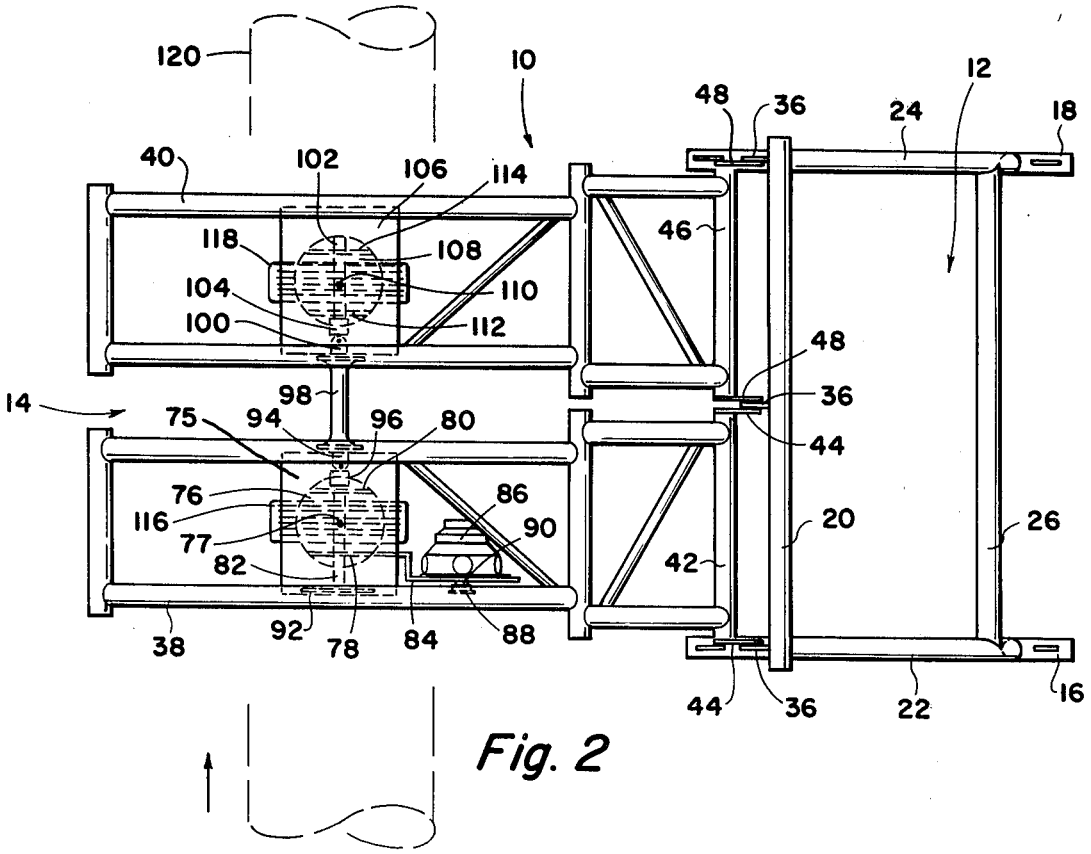
FIG. 2 is a plan view of a drive roller apparatus embodying the invention, with portions eliminated for purposes of illustration.

The outer end of each frame 38 and 40 is suspended above the surface of the ground; and in order to limit the downward movement thereof as the frames 38 and 40 pivot about the links 44 and 48, a lift apparatus generally indicated at 50 is connected in the proximity of the outer end of each frame 38 and 40, as particularly shown in FIG. 1. The lift apparatus as shown herein comprises a support base 52 disposed on the surface of the ground or floor and having an upright frame structure 54 suitably secured in the proximity of one end thereof. A suitable lift cylinder 56 is pivotally secured to the base 52 as shown at 58 and in spaced relation with respect to the frame 54. The lift cylinder 56 is provided with a reciprocal rod 60 which is yieldably supported in any well-known manner (not shown) and is normally constantly urged in an upward direction. The outer end of the rod 60 is pivotally secured at 62 to the outer end of a lift lever 64, and the opposite end of the lift lever 64 is pivotally secured at 66 to the upper portion of the frame 54. A rigid rod member 68 is pivotally secured at 70 to the outer end of the lift lever 64 oppositely disposed from the pivot connection 62. The rigid rod 68 extends upwardly for pivotal connection at 72 with the outer end of the frame 38. (Of course, a similar lift apparatus is provided for the frame 40). In addition, it may be desirable to provide a suitable weight member 74 in the proximity of the outer end of each frame 40. In this manner, the outer end of each frame 38 and 40 will be suspended in an elevated position by the lift cylinder 56 and connecting rod 68, and the weight 74 may be utilized for controlling the upper limit of the position of the outer end of the frames 38 and 40, if desired. It is to be noted, however, that the piston rod member 60 is yieldably supported in the cylinder 56 and if required during the use of the apparatus 10, the position of the outer end of the frames 38 and 40 may move below the normal elevated position thereof as determined by the normal position of the rod 60, as will be hereinafter set forth.

A plate member 75 is welded or otherwise rigidly secured to the frame 38, and a suitable support bracket 76 is secured to the plate member 75 in a manner whereby the bracket 76 may be rotated about a central point as indicated at 77. The bracket 76 is preferably provided with a pair of downwardly extending spaced flanges 78 and 80 for supporting an axle 82 therebetween. A motor mounting plate 84 is integral with or suitably secured to the flange 78 and extends outwardly therefrom for supporting a suitable motor 86, or the like. A first pulley member 88 is carried by the drive shaft 90 of the motor and is disposed in substantially coplanar relation with a second pulley member 92 secured to the outer end of the shaft 82. An endless belt 93 extends between and around the pulleys 88 and 92 for transmitting rotation from the motor 86 to the pulley 92, and hence to the shaft 82. The inwardly directed end of the shaft is pivotally connected to one end of a rod 94 by a suitably coupling means 96. The rod 94 is reciprocally disposed within a housing or sleeve 98 and may be selectively locked within the housing 98 at the desired longitudinal relationship therebetween by suitable set screw, or the like (not shown). A second rod 100 is reciprocally disposed within the housing 98 and extends outwardly from the opposite end thereof with respect to the rod 94. An axle 102, similar to the axle 82, is pivotally secured to the outer end of the rod 100 by suitably coupling means 104, and the rod 100 may be selectively locked within the housing 98 at the desired longitudinal relationship therebetween by suitable set screws, or the like (not shown) for a purpose as will be hereinafter set forth.

A plate 106 similar to the plate 75 is welded or otherwise rigidly secured to the frame 40, and a support bracket 108, similar to the bracket 76, is pivotally secured thereto in any suitable or well-known manner (not shown) for rotation about a central point as indicated at 110. The bracket 108 is preferably provided with a pair of spaced downwardly extending brackets 112 and 114 similar to the brackets 78 and 80 for supporting the shaft 102 therebetween. Of course, the shafts 82 and 102 are freely rotatable about their respective longitudinal axes.

A drive wheel 116 is carried by the shaft 82 and is keyed or otherwise secured thereto for rotation simultaneously therewith. The wheel 116 may be of any suitable type, but it is preferable that the wheel 116 be provided with an outer periphery having sufficient friction when engaged by an object for transmitting movement to the object as will be hereinafter set forth. As the shaft or axle 82 is rotated by the motor 86, the wheel 116 will be driven or rotated simultaneously with the axle 82.

A second wheel 118 preferably similar to the wheel 116 is keyed or otherwise secured to the shaft or axle 102 for simultaneous rotation therebetween. The wheel 118 is thus rotated in synchronization with the wheel 116.

In use, assuming that the drive apparatus 10 is to be utilized for moving pipe sections 120 through a pipe coating operation as set forth in my aforementioned cop-pending application entitled, "Pipe Coating System", the apparatus 10 is installed in such a manner that the upright standard 12 is disposed at one side of the path of travel of the pipe 120, and the lift apparatus 50 is disposed at the opposite side of the path of travel of the pipe 120, thus suspending the frames 38 and 40 transversely across the path of travel of the pipe 120. The outer periphery of each wheel 116 and 118 rides continusouly along the outer periphery of the pipe 120 as long as the pipe 120 is passing thereunder. It will be apparent that the weight 74 facilitates retaining of the wheels 116 and 118 in a firm and efficient engagement with the outer periphery of the pipe 120. Of course, the lift cylinder and connecting rod 68 limit the downward movement of the frames 38 and 40 when the wheels 116 and 118 are not in engagement with a pipe section for precluding undue downward movement of the wheels during the operation of the apparatus 10.

When the axles 82 and 102 are in position in substantial alignment with the longitudinal axis of the pipe section 120 and the motor 86 is activated for transmitting rotation to the wheel 116, the engagement between the wheel 116 and the outer periphery of the pipe 120 will cause the pipe to rotate about its own longitudinal axis, but no longitudinal movement will be transmitted to the pipe 120. When the wheels 116 and 118 are disposed in alignment with the longitudinal axis of the pipe 120, only longitudinal movement will be transmitted to the pipe. However, when the axle 82 is positioned at an angle with respect to the longitudinal axis of the pipe, the plane of the wheel 116 will be canted with respect thereto. In this position, rotation of the wheel 116 in engagement with the outer periphery of the pipe 120 will cause the pipe to rotate about its own longitudinal axis and to move in a longitudinal direction. Of course, the idler wheel 118 will also be in engagement with the outer periphery of the pipe, and it will be apparent that the angular position of the axle 102 must be complementary to the angular position of the shaft 82. In addition, it is to be noted that the angular position of the axles 82 and 102 with respect to the longitudinal axis of the pipe 120 will affect the rate of speed of the longitudinal movement of the pipe.

In order to provide the desired rotational and longitudinal speeds of the pipe 120, the required angular disposition of the axles 82 and 102 may be selected, and the axles may be manually or otherwise pivoted about the pivot connections with the respective rods 94 and 100. Of course, the movement of the axles will cause the rods 94 and 100 to reciprocate within the housing 98; and when the axles 82 and 102 have been properly positioned, the rods 94 and 102 may be locked in the selected position within the housing 98 as hereinbefore set forth.

In the pipe coating system set forth in my aforementioned co-pending applications, it may be desirable to utilize a plurality of the drive assemblies 10 spaced along the path of travel for the pipe sections moving through the pipe coating system.

From the foregoing, it wll be apparent that the present invention provides a novel drive apparatus wherein at least one drive roller is suspended for selective engagement with the outer periphery of an object for transmitting movement thereto. The wheel is positioned and driven in a manner for moving the object in a combined rotational and longitudinal movement, and the speed of longitudinal movement may be adjusted by the relative position of the wheel with respect thereto. In addition, lifting means is provided for limiting the downward movement of the suspended wheel means when no object is being engaged thereby. The novel apparatus is simple and efficient in operation and economical and durable in construction.

Whereas the present invention has been described in particular relation to the drawings attached hereto, it should be understood that other and further modifications, apart from those shown or suggested herein may be made within the spirit and scope of this invention.

What is claimed is:

1. Drive apparatus for moving cylindrical objects and comprising support means, overhead drive wheel means carried by said support means and engageable with the upper portion of said object for transmitting movement thereto, lift means cooperating with said support means for limiting the movement of said wheel means in a downward direction when out of engagement with said object, and wherein the support means comprises upright support standard means, wheel carrying support means pivotally secured at one end to said support standard means and extending outwardly therefrom for supporting the wheel means in an elevated position, the opposite end of said wheel carrying support means being connected with the lift means for limiting the downward movement of said wheel carrying support means.

2. Drive apparatus for moving cylindrical objects and comprising substantially upright frame means, overhead support means having one end pivotally secured to the frame means and spaced above the object, overhead drive wheel means carried by the support means and engageable with the upper portion of the object, power means carried by the support means and operably connected with the drive wheel means for transmitting rotation thereto whereby said drive wheel means transmits movement to the object, yieldable means operably connected with the opposite end of the support means for limiting the downward movement thereof when the drive wheel means is out of engagement with the object.

3. Drive apparatus for moving cylindrical objects as set forth in claim 2 wherein the yieldable means comprises a connecting rod pivotally connected at one end with the said opposite end of the support means, and lift cylinder means yieldably connected with the opposite end of the connecting rod for constantly urging the connecting rod in an upward direction.

4. Drive apparatus for moving cylindrical objects as set forth in claim 2 wherein the drive wheel means comprises at least one axle having a drive wheel journalled thereon for rotation about the longitudinal axis thereof, bracket means supporting the opposite ends of said axle and pivotally secured to the overhead support means for permitting adjustment of the angular orientation of the axle and the planar position of the drive wheel with respect to the longitudinal axis of the object whereby combined rotational and longitudinal movement is transmitted to the object.

5. Drive apparatus for moving cylindrical objects as set forth in claim 4 and including a second axle having a wheel journalled thereon for rotation about the longitudinal axis thereof, second bracket means supporting the opposite ends of said axle and pivotally secured to the overhead support means for selective adjustment of the longitudinal direction of the axle and planar position of the idler wheel with respect to the object, coupling means operably connected between the axles for transmitting rotation therebetween, and power means carried by one of said bracket means and operably connected with one of said axles for transmitting rotation thereto.

* * * * *